US011029126B1

(12) United States Patent
Silva

(10) Patent No.: US 11,029,126 B1
(45) Date of Patent: Jun. 8, 2021

(54) HOLSTER SYSTEM AND METHODS OF MAKING AND USING THE SAME

(71) Applicant: John Silva, Fayetteville, NC (US)

(72) Inventor: John Silva, Fayetteville, NC (US)

( * ) Notice: Subject to any disclaimer, the term of this patent is extended or adjusted under 35 U.S.C. 154(b) by 0 days.

(21) Appl. No.: 17/070,428

(22) Filed: Oct. 14, 2020

(51) Int. Cl.
*F41C 33/02* (2006.01)
*F41C 33/04* (2006.01)

(52) U.S. Cl.
CPC ..... *F41C 33/0236* (2013.01); *F41C 33/046* (2013.01)

(58) Field of Classification Search
CPC .. F41C 33/046; F41C 33/0245; F41C 33/041; F41C 33/0236
USPC ..... 224/245, 243
See application file for complete search history.

(56) References Cited

U.S. PATENT DOCUMENTS 1,768,177 A * 6/1930 Wanee ..... F41C 33/041 224/674
2,401,174 A * 5/1946 Mcauley ..... F41C 33/0236 224/243
2,765,107 A * 10/1956 Browning ..... F41C 33/0245 224/255
3,265,259 A * 8/1966 Marburger ..... F41C 33/0245 224/193
3,353,728 A * 11/1967 Freed ..... F41C 33/0227 224/243
3,642,184 A * 2/1972 Hendricks ..... F41C 33/0245 224/666
3,796,358 A * 3/1974 Grubb ..... F41C 33/0263 224/255
5,611,471 A * 3/1997 French ..... F41C 33/008 224/243
5,749,507 A * 5/1998 Wood ..... F41A 23/18 224/255
9,574,847 B2 * 2/2017 Rossi ..... F41C 33/0245
10,408,566 B2 * 9/2019 Pagac ..... F41C 33/0245
2013/0327799 A1 * 12/2013 Sitz ..... F41C 33/0245 224/243
2015/0345899 A1 * 12/2015 Bardy ..... F41C 33/0272 224/243

* cited by examiner

*Primary Examiner* — Corey N Skurdal
(74) *Attorney, Agent, or Firm* — Dogwood Patent and Trademark Law; Ashley D. Johnson

(57) ABSTRACT

The presently disclosed subject matter is generally directed to a holster system that allows for quick and secure release of a weapon, while also allowing attachment to a wide variety of connectors. The holster system comprises a frame that interacts with and safeguards a weapon (e.g., a gun). The frame includes a fastener band that acts as a trigger guard and releasably secures the weapon to the holster. The frame further includes a barrel plug that acts as a vertical rest and stabilizer when the weapon is holstered, keeping the weapon secured. The frame cooperates with a spacer to allow attachment to a wide variety of connectors. The holster system enables the weapon to be securely maintained when not in use, yet available if needed by the user. The holster can be configured with an ambidextrous feature, allowing both left-hand and right-hand weapon draws.

20 Claims, 19 Drawing Sheets

HOLSTER SYSTEM AND METHODS OF MAKING AND USING THE SAME

TECHNICAL FIELD

The presently disclosed subject matter is generally directed to a weapon holster system, and to methods of making and using the disclosed system.

BACKGROUND

Holsters are well-known articles for carrying and/or concealing guns and other weapons on an operator's body or within reach of the operator. Many holsters are designed for wearing on a belt or waistband, while others include harnesses or straps for wearing around the torso, arms, legs, or ankles. However, conventional holsters have many drawbacks. For example, numerous prior art holsters rely on friction to secure the weapon in the holster. However, a friction hold has been shown to be unsuitable during certain movements of the wearer, causing the frictional grip of the holster on the gun to be broken. Other conventional holsters rely on an "over-center" design that incorporates one or more springs to secure the gun. Over time, the springs can become compressed. As a result, an unexpected release of the gun from the holster can occur. Additional holster designs have incorporated straps, flaps, hood enclosures, and the like to secure the gun therein. However, unfastening such enclosures before drawing the gun takes an unacceptable amount of time which can be critical in many circumstances, such as combat. Further, prior art holsters are typically suitable for use with a single type of connector, such that a variety of holsters may be required. Prior art holsters are also limited to either a right side or left side weapon draw. As a result, when an operator wishes to reposition the holster to the opposing side, a new holster oriented in the opposite direction must be used. It would therefore be desirable to provide a holster that allows a weapon to be easily and quickly holstered and unholstered. It would further be beneficial if the holster was universal, being suitable for use with a variety of conventional connectors. Further, it would be beneficial if the holster provided an ambidextrous feature, allowing both left-hand and right-hand weapon draws.

SUMMARY

In some embodiments, the presently disclosed subject matter is directed to a holster system. Specifically, the holster system comprises a support frame defined by: a support frame front face, a support frame rear face, a first end defined by an attachment plate comprising a plate front face and a plate rear face, a second end defined by a ledge, wherein the ledge comprises a top face and a bottom face, and a bracket disposed between the first and second ends. The attachment plate comprises a plurality of slots. The system comprises a barrel plug positioned on the top face of the bracket. The system includes a spacer positioned directly adjacent to the rear face of the support frame, wherein the spacer is defined by a plurality of apertures that align with the attachment plate slots. The system includes a fastener band comprising a closure, wherein a portion of the fastener band is positioned between the rear face of the support frame and the front face of the spacer. The front face of the spacer, the rear face of the support frame, or both comprise a groove sized and shaped to accommodate the portion of the fastener band positioned between rear face of the support frame and the front face of the spacer.

In some embodiments, the holster system further comprises an optional covering that at least partially fits over the support frame, wherein the covering includes a plurality of openings that align with the support frame slots and the spacer apertures.

In some embodiments, the holster system further comprises a connector releasably attached to the rear face of the spacer via the spacer apertures.

In some embodiments, the holster system comprising about 2-20 slots, apertures, or both.

In some embodiments, the holster system comprises a first segment that includes the barrel plug and a second section attached to the bracket, wherein the first and second segments can be releasably attached together.

In some embodiments, the support frame is configured as in an L-shape.

In some embodiments, the barrel plug comprises a first end and a second end, and wherein the barrel plug tapers from the second end to the first end.

In some embodiments, the fastener band further includes an adjuster that allows the band to be enlarged or decreased in circumference.

In some embodiments, the apertures are optionally threaded.

In some embodiments, the apertures of the spacer are configured to provide universal connectivity to two or more different connectors.

In some embodiments, the holster system further comprises an attachment strap that allows the system to be releasably attached to a support surface.

In some embodiments, the holster system is configured to switch between right-hand and left-hand orientations.

In some embodiments, the presently disclosed subject matter is directed to a holster system kit comprising at least one support frame, each frame comprising: a support frame front face; a support frame rear face; a first end defined by an attachment plate comprising a plate front face and a plate rear face; a second end defined by a ledge, wherein the ledge comprises a top face and a bottom face; and a bracket disposed between the first and second ends; wherein the attachment plate comprises a plurality of slots. The kit includes at least one barrel plug configured to be attached to the top face of the bracket. The kit comprises at least one spacer positioned directly adjacent to the rear face of the support frame, wherein the spacer is defined by a plurality of apertures that align with the attachment plate slots. The kit comprises at least one fastener band comprising a closure, wherein a portion of the fastener band is positioned between the rear face of the support frame and the front face of the spacer. The front face of the spacer, the rear face of the support frame, or both comprise a groove sized and shaped to accommodate the portion of the fastener band positioned between rear face of the support frame and the front face of the spacer.

In some embodiments, the kit further comprises: at least one optional covering at least partially fits over the support frame, wherein each covering comprises a plurality of slots; at least one connector configured to releasably attach to the rear face of the spacer via the spacer apertures; at least one attachment strap that allows the system to be releasably attached to a support; or combinations thereof.

In some embodiments, the kit further comprises at least one connector configured to releasably attach to the rear face of the spacer via the spacer apertures.

In some embodiments, the presently disclosed subject matter is directed to a method of releasably attaching a connector to a holster system. Particularly, the method comprises selecting a desired connector, and releasably attaching the connector to the rear face of a holster system spacer by aligning connector openings with aligned apertures in the spacer and securing together using a mechanical element. The holster system comprises: a support frame comprising a support frame front face, a support frame rear face, a first end defined by an attachment plate comprising a plate front face and a plate rear face, a second end defined by a ledge, wherein the ledge comprises a top face and a bottom face, and a bracket disposed between the first and second ends. The attachment plate comprises a plurality of slots. The system comprises a barrel plug positioned on the top face of the bracket. The system includes a spacer positioned directly adjacent to the rear face of the support frame, wherein the spacer is defined by a plurality of apertures that align with the attachment plate slots. The system comprises a fastener band comprising a closure, wherein a portion of the fastener band is positioned between the rear face of the support frame and the front face of the spacer. The front face of the spacer, the rear face of the support frame, or both comprise a groove sized and shaped to accommodate the portion of the fastener band positioned between rear face of the support frame and the front face of the spacer. The connector can be detached from the spacer and replaced with a different connector.

In some embodiments, the connector is selected from clips, strap connectors, locking forks, mounters, locking systems, or clip-on holster belt loops.

DETAILED DESCRIPTION

Figure 1A:
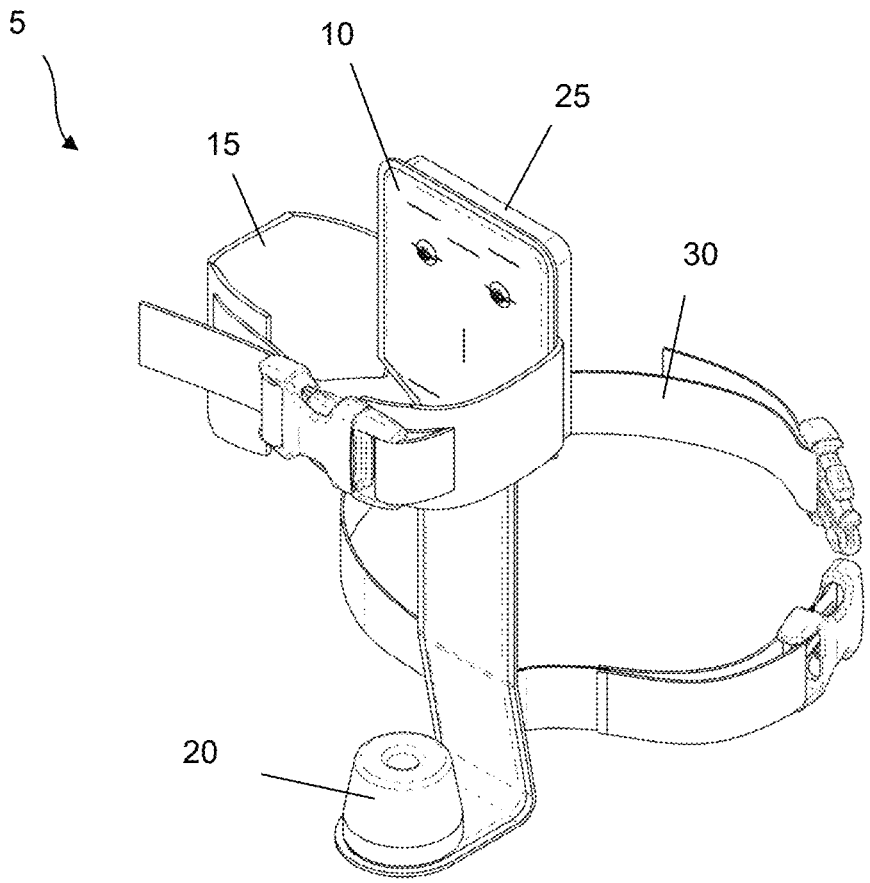
FIG. 1*a* is a perspective view of a holster system in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Figure 1B:
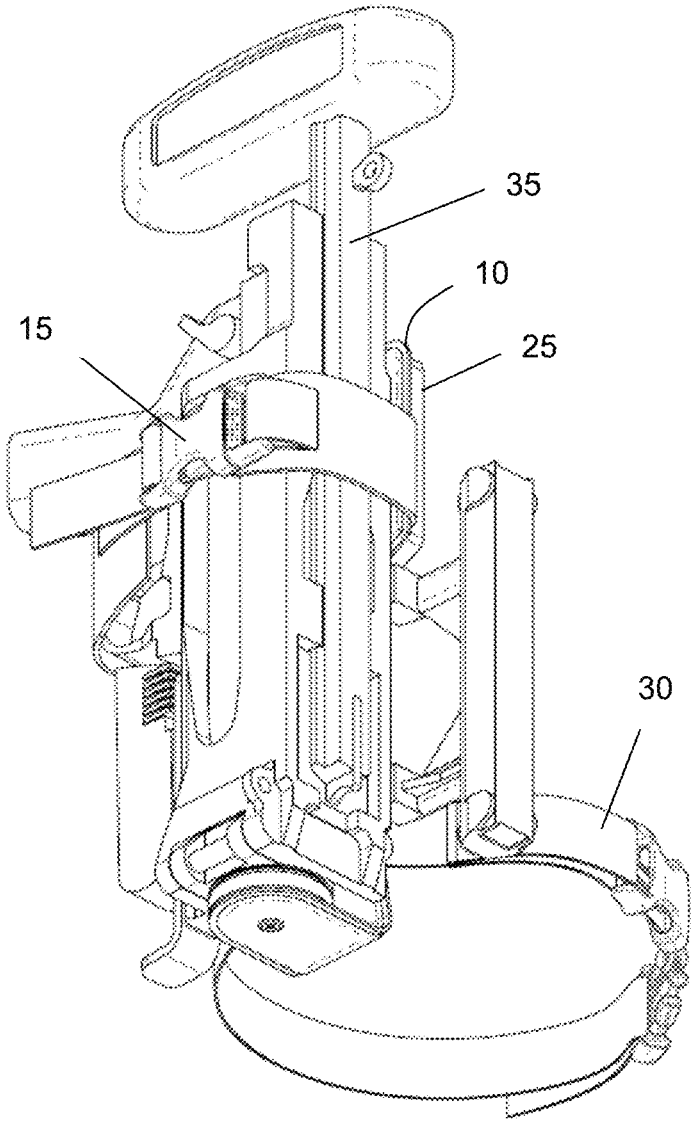
FIG. 1*b* is a perspective view of a holster system comprising a weapon in accordance with some embodiments of the presently disclosed subject matter.

The presently disclosed subject matter is generally directed to a holster system that allows for quick and secure release of a weapon, while also allowing attachment to a wide variety of connectors. FIG. 1*a* illustrates one embodiment of holster system 5 comprising frame 10 that interacts with and safeguards a weapon (e.g., a gun). The frame includes fastener band 15 that acts as a trigger guard and releasably secures the weapon to the holster. The frame further includes barrel plug 20 that acts as a vertical rest and stabilizer when the weapon is holstered, keeping the weapon secured. The frame cooperates with spacer 25 to allow attachment to a wide variety of connectors, as described in detail below. The holster can be releasably attached to the operator or adjacent equipment using optional attachment strap 30. For example, in some embodiments, the attachment strap allows holster 5 to be releasably connected to a user's leg. FIG. 1*b* illustrates one embodiment of holster system 5 comprising weapon 35 releasably secured to the holster. As described in detail below, the holster enables the weapon to be securely maintained when not in use, yet available if needed by the user. Weapon 35 can be easily released from the holster (e.g., when in combat).

Figure 2A:
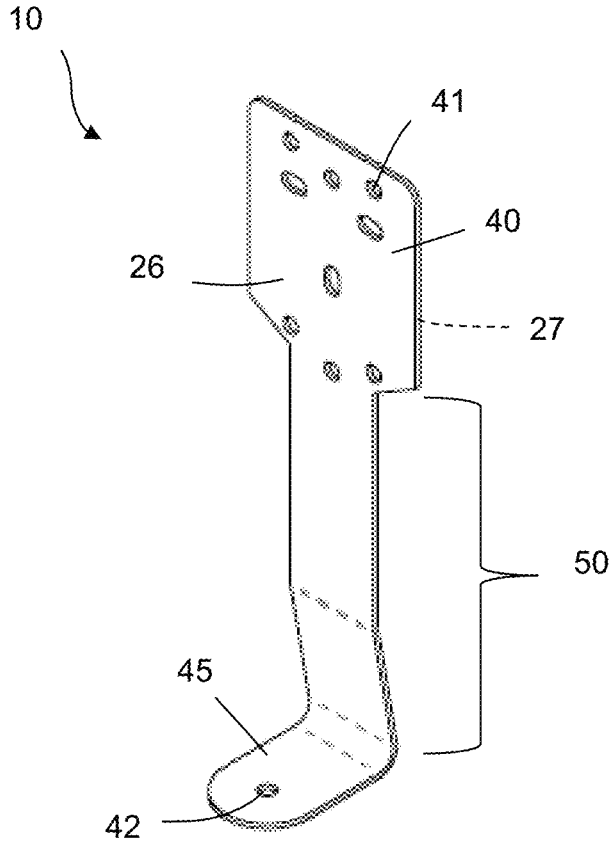
FIG. 2*a* is a perspective view of a holster system frame in accordance with some embodiments of the presently disclosed subject matter.

FIG. 2*a* illustrates one embodiment of frame 10 that provides structural support for the holster. As shown, the frame includes plate 40 that allows for the attachment of spacer 25 and one or more connectors. The frame further includes ridge 45 that provides for the attachment of barrel plug 20, and bracket 50 positioned between the plate and ridge. The frame also includes opposing front and rear faces 26, 27. The frame front face is positioned towards a corresponding weapon, while the opposed rear face is positioned away from the weapon. Advantageously, the contour of frame 10 allows for proper alignment of both right hand and left hand draws of an associated weapon, as described below.

Plate 40 can include a series of spaced apart retention slots 41 that allow the releasable attachment of a variety of connectors. For example, the retention slots can be configured in a pattern that allows for the attachment of spacer 25, fastener band 15, and at least one desired connector. The retention slots can include any shape (e.g., circular, oval, square, triangular, rectangular, abstract, and the like). Similarly, the retention slots can have any suitable size (e.g., a diameter of 0.1-1 inches). The term "diameter" refers to the longest length that passes through the center of a cross-sectional segment of the retention slot.

Further, the system can include any number of retention slots 41. For example, plate 40 can include about 1-20 (e.g., at least/no more than about 1, 2, 3, 4, 5, 6, 7, 8, 9, 10, 11, 12, 13, 14, 15, 16, 17, 18, 19, or 20) retention slots. However, the disclosed holster system is not limited, and the plate can include greater than 20 retention slots. In other embodiments, the plate is configured without retention slots and the plate, fastener band, and connector can be attached using other linking mechanisms (e.g., the use of magnets, fasteners, VELCRO®, and the like).

Ridge 45 is sized and shaped to accommodate a barrel plug. To this end, the ridge can include at least one bore 42 (e.g., a slotted bore). The bore functions to allow the barrel plug to be connected or adjusted relative to the frame. Thus, the bore allows the barrel plug to be horizontally adjusted perpendicularly relative to the frame in some embodiments. For example, in some embodiments one or more screws can be inserted via bore 42 to secure the plug in proper position. However, the presently disclosed subject matter is not limited and ridge 45 can be configured without bore 42 and the barrel plug attached in an alternate way (e.g., the use of adhesives, magnets, and the like).

Figure 2B:
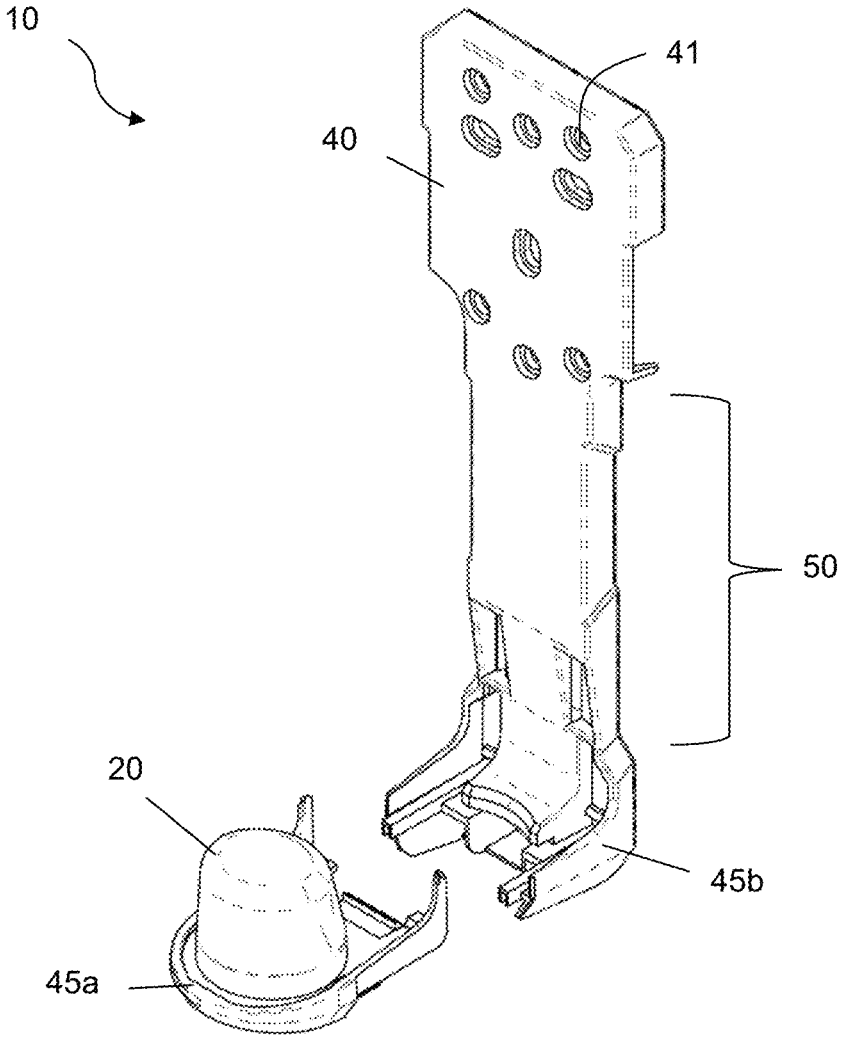
FIG. 2*b* is a perspective view of a holster system frame in accordance with some embodiments of the presently disclosed subject matter.

FIG. 2*b* illustrates an alternate embodiment of frame 10 comprising 2-piece ridge 45 that can be customized with any barrel plug or other element as desired by the user. The ridge includes first and second sections 45*a* and 45*b* that can releasably attach together using any known mechanism, such as (but not limited to) a snap-fit connection, pressure fit connection, magnets, the use of mechanical elements (e.g., screws, pins, fasteners, clips), and the like. Advantageously, first ridge section 45*a* can be added and removed as desired based on a corresponding barrel plug needed for a particular weapon.

Figure 2C:
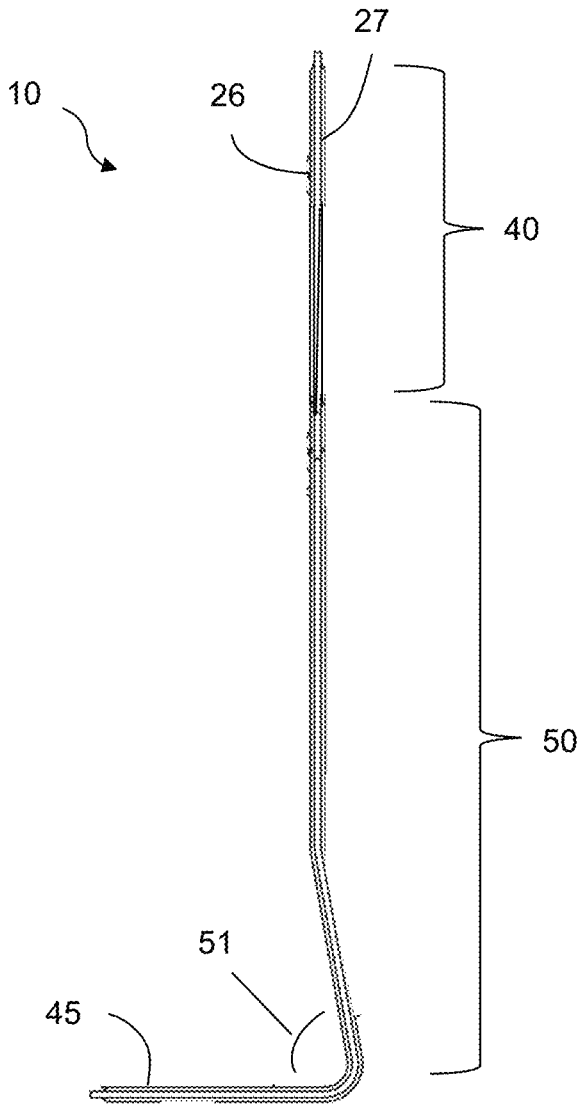
FIG. 2*c* is a side plan view of a holster system frame in accordance with some embodiments of the presently disclosed subject matter.

In some embodiments, the frame can be configured as an L-shaped support, as shown in FIG. 2*c*. However, the shape of the frame is not limited so long as it includes plate 40 that allows an accessory to be mounted proximal to the holster, and ridge 45 for the attachment of a barrel plug.

In the use position, plate 40 and bracket 50 of the frame can be about vertical in orientation to keep weapon 35 upright and easily accessible to the user. In some embodiments, ridge 45 can be positioned at angle 51 relative to bracket 50 (e.g., a right angle). For example, the angle between the ridge and bracket 50 can be about 90 degrees (e.g., at least/no more than about 75, 80, 85, 90, 95, 100, 105, or 110 degrees). However, the presently disclosed subject matter is not limited and the angle can be greater or less than the range given.

The frame can be constructed from any rigid or semi-rigid material. The term "rigid material" refers to a material that is stiff and does not stretch easily and/or maintains very close to its original form after a force or pressure has been applied to it. The term "semi-rigid material" refers to a material that can flex but has sufficient rigidity to retain a desired self-supported shape. Thus, suitable materials can include (but are not limited to) wood, metal (e.g., stainless steel, aluminum, titanium), metal alloys, polymeric material, composite material, polymer fiber or fiber reinforced metals, carbon fiber or glass fiber composites, carbon fiber, epoxy laminates, or combinations thereof. It should be appreciated that the material or materials used to form frame 10 is a design choice based on desired appearance and functionality.

Frame 10 can be constructed using any known method, such as (but not limited to) thermoforming, welding, injection molding, machining, and the like. Such methods are well known in the art. The frame can be formed as a one-piece member. Alternatively, the frame can be formed in multiple pieces that can be permanently or releasably assembled together.

The retention slots and bore 42 can be integrally formed with the frame.

Alternatively, conventional methods can be used to construct the holes and bore, such as the use of lasers and the like.

Figure 3A:
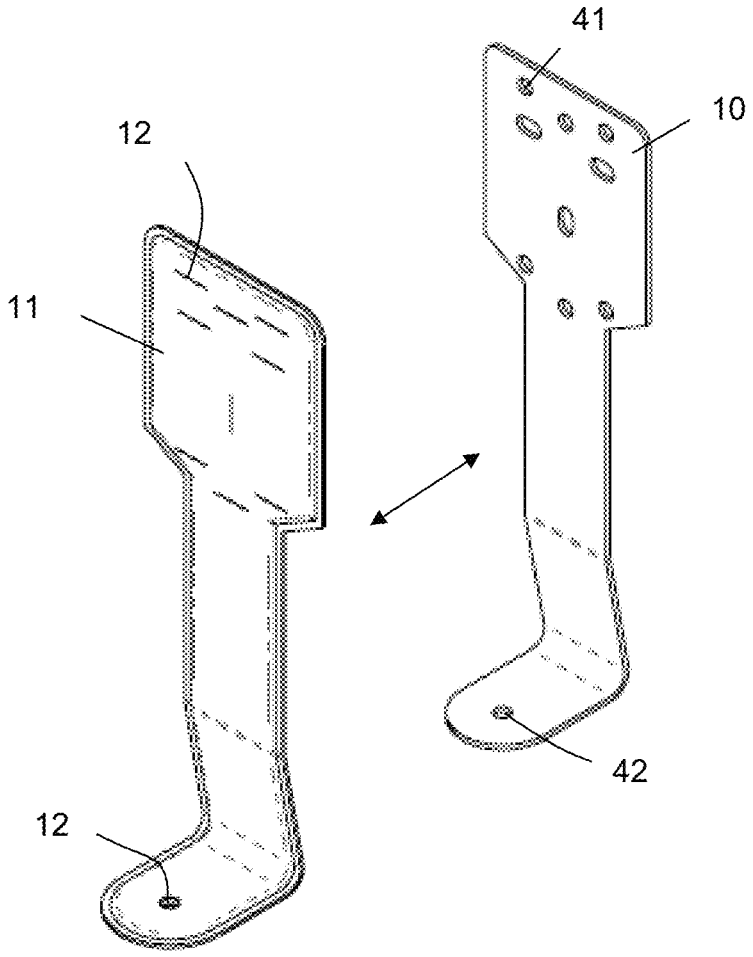
FIGS. 3*a* and 3*b* illustrate a holster system frame comprising an optional covering in accordance with some embodiments of the presently disclosed subject matter.
Figure 3B:
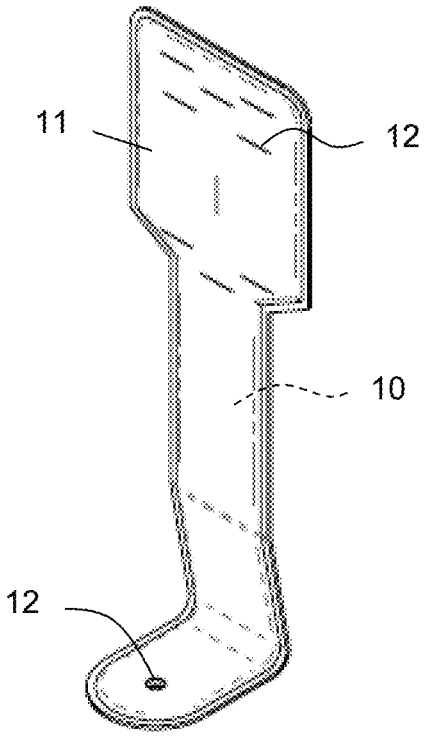

As illustrated in FIGS. 3*a* and 3*b*, at least one face of frame 10 can include covering 11 to provide an added level of protection and/or comfort to the user. For example, the covering can optionally provide protection from cosmetic damage due to contact with the frame of the holster and exposed fastener hardware. In addition, the thickness of the frame may not allow for the associated metal hardware to be countersunk. In these embodiments, the covering helps protect the holstered weapon from cosmetic blemishes due to contact with the frame and/or fastener hardware. In some embodiments, the entire frame can be obscured with covering 11. The covering can be constructed from any durable material, such as (but not limited to) fabric and the like. For example, in some embodiments, the covering can comprise nylon CORDURA® material. In some embodiments, the material used to construct the covering include an elastic quality to allow the covering to be tightly stretched over the frame, providing a snug fit.

Covering 11 can be constructed to have about the same shape as frame 10 to allow for a tight fit. The covering can be releasably or permanently attached to the frame using standard techniques. For example, adhesives, heat sealing, fasteners, and the like can be used.

The covering can include a plurality of openings 12 that align with the retention slots in the frame to allow a screw or other mechanical element to pass therethrough. The openings can have any desired shape, such as a slit or hole. In embodiments wherein the frame lacks retention elements 41 and bore 42, the covering can likewise be configured without openings 12.

Covering 11 can have any desired color or pattern. Particularly, the covering can be transparent or opaque and can include any color or combination of colors. For example, the covering can be camouflage or "hunter orange" (although any color(s) and patterns can be used). In this way, the holster system can meet or correspond to any desired camouflage or coloring standards.

It should be appreciated that covering 11 is optional and frame 10 can be used without a covering. For example, the external surface of all or a portion of the frame can be painted or coated in a desired color and/or pattern. Alternatively, the frame can be injection molded to include color pigmentation in the composite material. Thus, covering 11 is not always required for coloration.

Figure 4A:
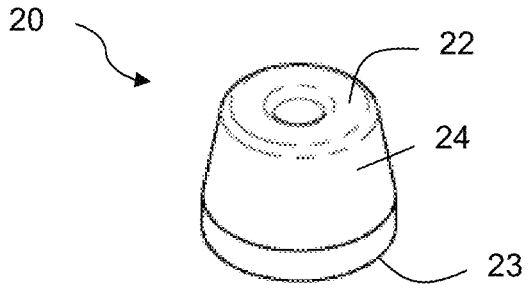
FIG. 4*a* is a perspective view of a barrel plug in accordance with some embodiments of the presently disclosed subject matter.

The disclosed holster system includes barrel plug 20. One embodiment of the barrel plug is illustrated in FIG. 4*a*. The barrel plug includes first and second ends 22, 23 with intermediate portion 24 disposed therebetween. The intermediate portion can taper in diameter from the first end to the second end. Alternatively, the barrel plug can have a diameter that is consistent from first end 22 to second end 23.

Plug 20 can be constructed from any desired material, such as (but not limited to) polymeric material, rubber, metal, silicone, foam, and the like.

The intermediate portion of plug 20 is configured with a diameter that is approximately the same or slightly smaller than the diameter of a corresponding weapon barrel. Thus, the first end and at least a portion of intermediate portion 24 (and optionally second end 23) are configured for engaging with the weapon barrel into which the plug is inserted. In this way, plug 20 is disposed and retained within the barrel of a weapon for a desired amount of time. As a result, barrel plug 20 acts as a vertical rest and stabilizer when the weapon is holstered, keeping the weapon secure. In addition, debris is prevented from entering the weapon barrel while holstered.

Figure 4B:
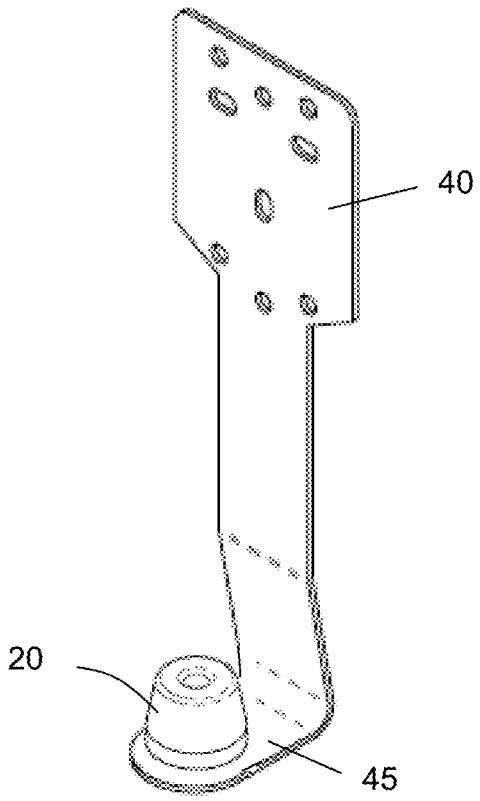
FIG. 4*b* is a perspective view of a holster system frame comprising a barrel plug in accordance with some embodiments of the presently disclosed subject matter.
Figure 4C:
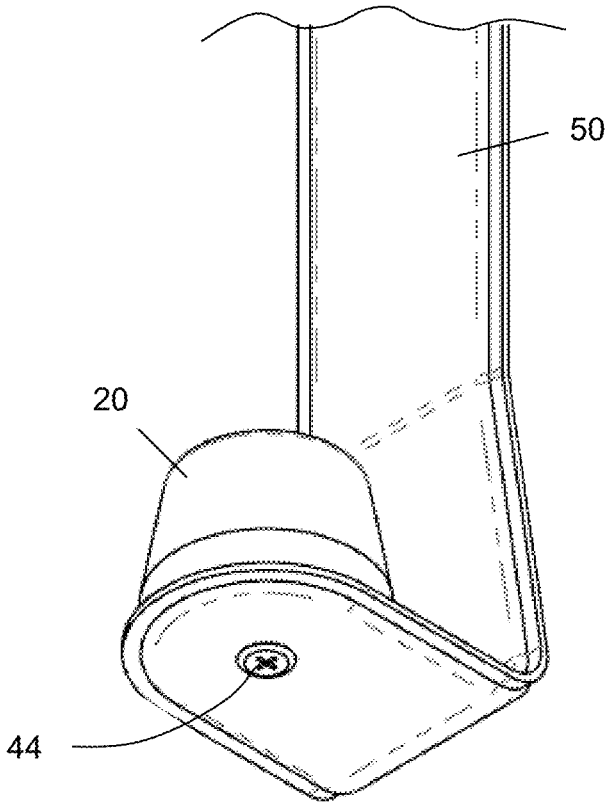
FIG. 4*c* is a fragmentary perspective view illustrating a barrel plug attached to a holster system frame in accordance with some embodiments of the presently disclosed subject matter.

As shown in FIG. 4*b*, barrel plug 20 is attached to the top surface of ridge 45 using any known mechanism. For example, the plug can be permanently attached to the ridge using adhesives, welding, and the like. Alternatively, the plug can be releasably attached using magnets, VELCRO®, clips, screws, nuts, bolts, fasteners, ties, and the like. For example, bore 42 can be sized and shaped to allow screw 44 to pass through the ridge and attach the plug, as shown in FIG. 4*c*. Releasable attachment to the ridge allows the user to customize the plug for a particular weapon size. The barrel plug can also be removed for cleaning as needed.

Figure 5A:
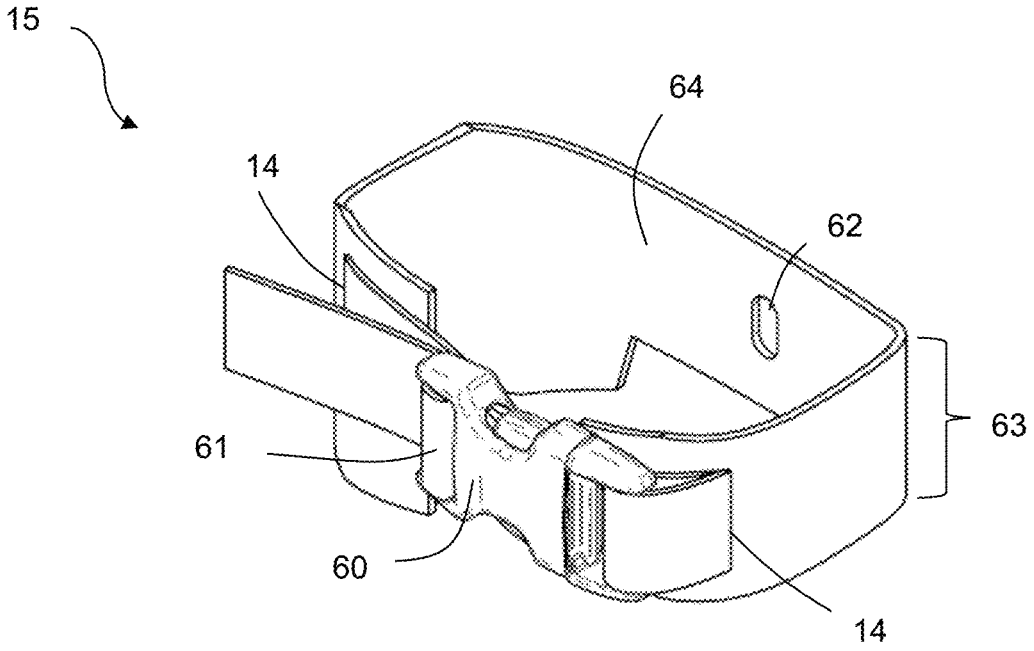
FIG. 5*a* is a perspective view of a holster system fastener band in accordance with some embodiments of the presently disclosed subject matter.

As set forth above, holster system 5 further includes fastener band 15. The fastener band retains the weapon adjacent to frame 10, and also allows for a quick and snag-free draw of the weapon from the holster. FIG. 5*a* illustrates one embodiment of fastener band 15. As shown, the fastener band is releasably configured around weapon 35. The band is configured in a loop of any desired shape that can be opened and closed.

Specifically, the band includes closure 60 that allows the strap to be opened (such as when a gun is added to or removed from the holster) and closed (such as when a gun is secured within the holster). The ends of the band are coupled together with closure 60. Closure 60 can have any desired configuration, such as (but not limited to) one or more buckles, snaps, buttons, zippers, clips, magnets, VELCRO®, or other fasteners. For example, the closure can be configured as a side release buckle, center release buckle, cam buckle, and the like.

The fastener band further includes proximal routing slit 14 that allows an inner strap to be pushed or pulled through. Closure buckle 60 and adjuster 61 are attached to each distal end of the inner strap, respectively. In other words, the routing slit is where the band webbing emerges from the fastener strap. The routing slit is useful when properly sizing the fastener band and/or when switching orientation of the holster system, as discussed in more detail below. In some embodiments, the closure includes adjuster 61 to allow the band to be tightened or loosened to accommodate a particular weapon. For example, at least one end of the band can slidably pass through the adjuster and can be pulled to tighten the band. The free end of the band can dangle from the fastener or can be secured with a loop or other element. Conversely, the band can be fed into adjuster 61 to loosen. It should be appreciated that the holster system is not limited and any element that can loosen or tighten the band can be used.

Closure 60 and adjuster 61 can be constructed from any desired material, such as (but not limited to) polymeric material, metal, and combinations thereof.

Figure 5B:
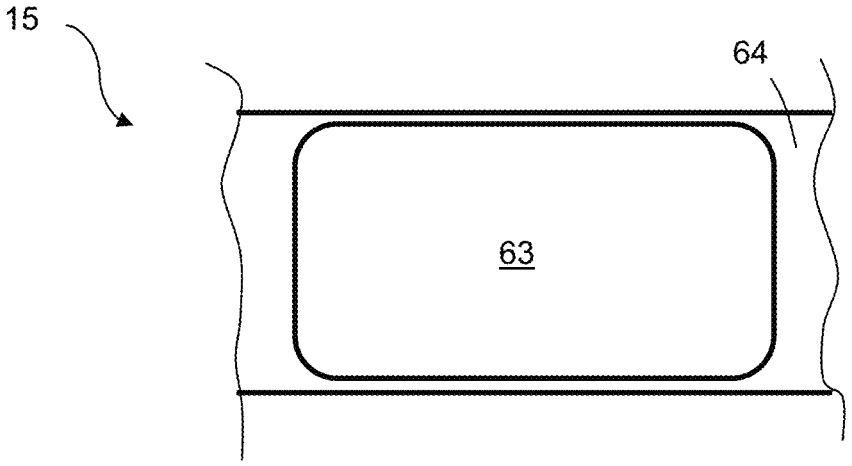
FIG. 5*b* is a fragmentary view illustrating a padded fastener band in accordance with some embodiments of the presently disclosed subject matter.

In some embodiments, at least a portion of interior face 64 of the band can include padding materials to protect weapon 35 and prevent excessive movement of the weapon when the holster system is being moved (i.e., the operator is running or walking). One embodiment of padding 63 is illustrated in FIG. 5*b*. The padding material can include any cushioning or soft material, such as (but not limited to) foam, cloth, fabric, air cellular material, and the like.

The fastener band can be configured in any suitable length, width, thickness, and strength. In some embodiments, the fastener band can be customized to fit a desired weapon.

Fastener band 15 can be attached to the frame using any known mechanism. For example, the fastener band can be adhesively attached to the frame. In other embodiments, the band can be releasably attached to the frame. For example, the band can be attached to the frame by passing a mechanical element (e.g., screw or pin) through one or more band openings 62. The openings can have any desired shape and size.

Band 15 can be constructed from any desired material, such as (but not limited to) nylon, polyester, leather, fabric, molded plastic, plastic and the like.

As described in more detail below, a portion of the band (e.g., the section opposing closure 60 can be positioned between the frame and a spacer. Specifically, the spacer can include a groove sized and shaped to fit a section of the band. The band can then be seated within the groove and secured in place. Alternatively, rear face 27 of the frame plate can include a groove sized and shaped to accommodate band 15.

Advantageously, the fastener band protects the operator from unintentional discharge of the weapon while holstered. The fastener band closure also allows the user to easily and quickly unholster a weapon from holster system 5.

It should be appreciated that the fastener band is not limited to the embodiment of FIG. 5*a* and can include any element comprising a circumferential band and a releasable closure.

Figure 6A:
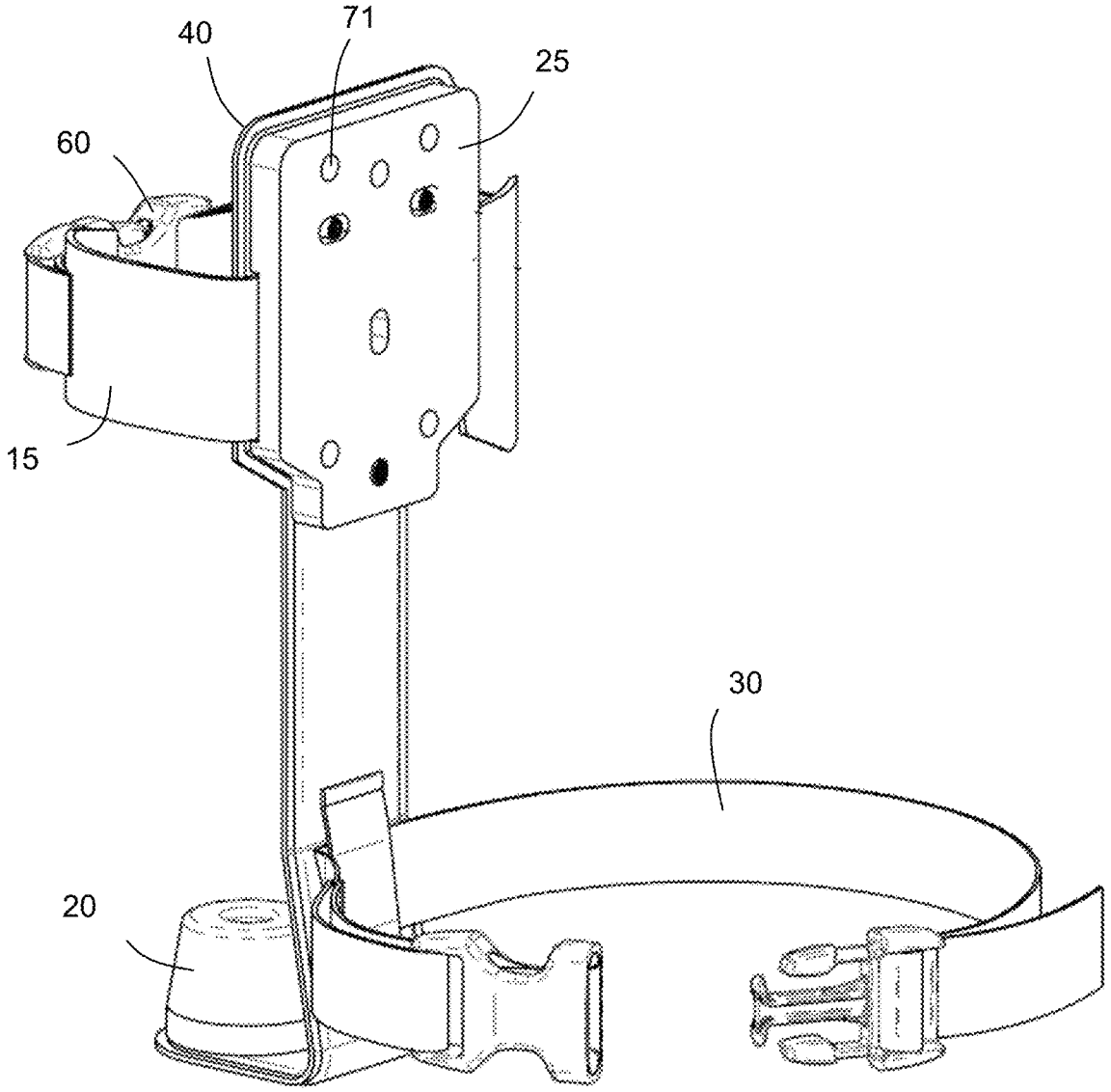
FIG. 6*a* is a perspective view illustrating a holster system in accordance with some embodiments of the presently disclosed subject matter.
Figure 6B:
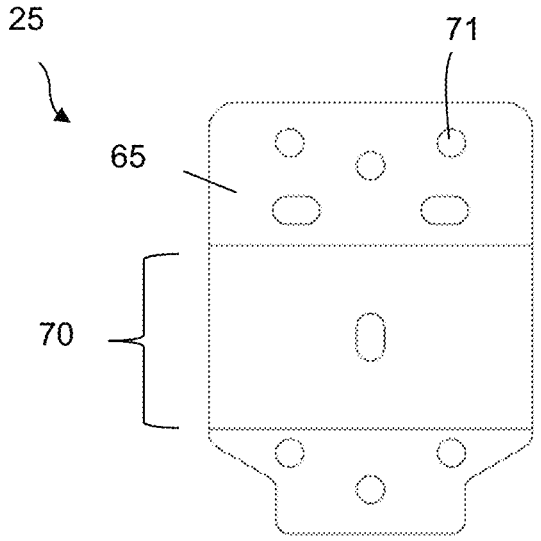
FIG. 6*b* is a top plan view of a spacer in accordance with some embodiments of the presently disclosed subject matter.
Figure 6C:
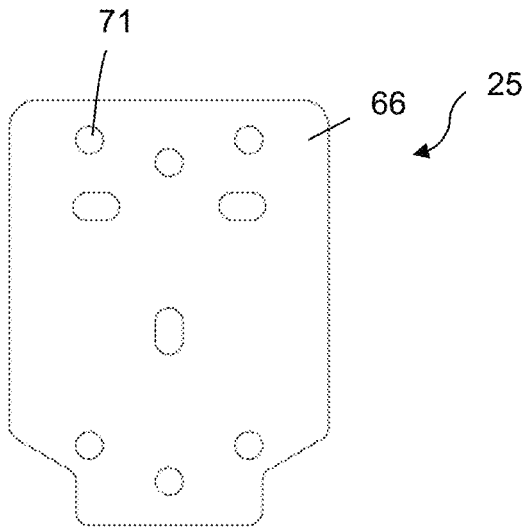
FIG. 6*c* is a bottom plan view of a spacer in accordance with some embodiments of the presently disclosed subject matter.
Figure 6D:
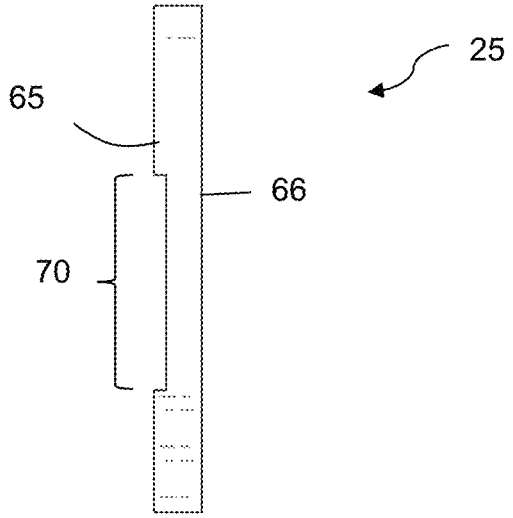
FIG. 6*d* is a side plan view of a spacer in accordance with some embodiments of the presently disclosed subject matter.

Spacer 25 is attached to the rear side of frame 10, as shown in FIG. 6*a*. The spacer functions as an adaptor, allowing one or more connectors (e.g., accessories) to be attached to the holster system. Accordingly, the disclosed holster system can be used with various styles of mounted accessories. In some embodiments, the spacer can have about the same size and shape as plate 40 of the frame. However, the spacer is not limited and can be configured to be larger, smaller, or differently shaped when compared to the frame plate. One embodiment of spacer 25 is illustrated in FIGS. 6*b*-6*d*. As shown, the spacer can be configured as a planar member with front and rear sides 65, 66. The front side directly contacts rear face 27 of the frame. The front side further can include groove 70 to accommodate a portion of the fastener band 15 strap (i.e., the band passes between the rear face of the frame and the front side of the spacer). The groove helps prevent misalignment of the fastener band. Groove 70 therefore can have a depth equal to or greater than the thickness of strap 15. Similarly, the groove can have a thickness that is equal to or larger than strap thickness 63.

The spacer can include a plurality of apertures 71 that allow a screw or fastener to pass therethrough. Apertures 71 are aligned with some or all corresponding retention slots of frame 10. In this way, the apertures allow for releasable attachment of the spacer to the frame. The apertures further allow for a corresponding connector to be attached to the holster system. The spacer therefore serves as an interface between the frame and an associated connector.

In some embodiments, some or all of apertures 71 may be threaded to allow a screw or bolt to pass therethrough. However, other joining mechanisms can be used, such as adhesive, VELCRO®, magnets, snaps, fasteners, clips, and the like. Further, in some embodiments, the apertures are non-threaded.

Apertures 71 can be formed using any suitable method, as milling, injection molding, and the like.

Spacer 25 can be constructed from any desired material, such as (but not limited to) metal, metal alloys, plastic, carbon-fiber composites, leather, wood, and the like.

Figure 6E:
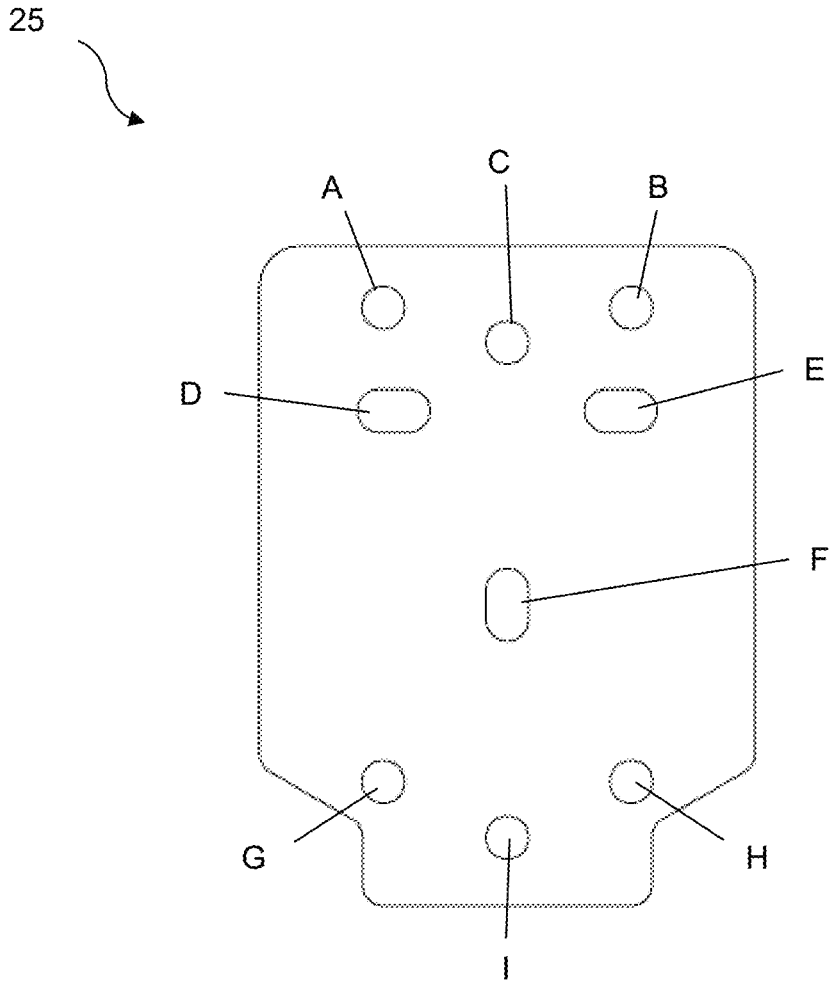
FIG. 6*e* is a bottom plan view of a spacer in accordance with some embodiments of the presently disclosed subject matter.

Advantageously, the apertures of spacer 25 can be configured to provide universal connectivity to a wide variety of connectors. FIG. 6*e* illustrates one embodiment of spacer 25 with apertures 71 labeled as A-I. For example, apertures A and B can be horizontally aligned and positioned on the upper left-hand and right-hand corner areas of the plate.

Aperture C can be positioned along the vertical midline of the spacer, and horizontally slightly below apertures A and B. Apertures D and E can be configured to be elongate and horizontally aligned with each other beneath apertures A and B. Aperture F can be elongate and aligned along the vertical midline of the spacer, approximately halfway between the horizontal line of apertures D and G. Holes G and H can be horizontally aligned and positioned in the lower left-hand and right-hand corner areas of the plate, and vertically aligned with holes A and B. Hole I can be positioned along the vertical midline of the spacer, and horizontally slightly below apertures G and H. The design of the apertures provides for attachment of a wide variety of connectors. For example, holes A, B, F, and I provide for attachment of the novel designed MOLLE strap connector provided with the holster as shown herein. Table 1 below illustrates several conventional connectors that can be releasably attached to the spacer using one or more apertures 71.

TABLE 1

| Aperture Nos. | Connector | Source |
|---|---|---|
| A, B, F, G, I | MALICE CLIPS ® | Tactical Tailor, Lakewood, Washington, United States |
| A, F or B, F | Blackhawk Quick Disconnect (Male Side) Strap Connector | Vista Outdoor, LLC, Anoka, Minnesota, United States |
| D, E, and F | Blackhawk S.T.R.I.K.E. ® Platform Ambidextrous Strap Connector | Vista Outdoor, LLC, Anoka, Minnesota, United States |
| D, E, F, and I | 745BL Clip-On Holster Belt Loop | Safariland, Ontario, Canada |
| D, E, F and I | QLS (Quick Locking System) Model 6004-15 Molle Locking Fork | Safariland, Ontario, Canada |
| D, E, F, and I | GCA39 Universal RTI Hanger | G-Code/Edge Works Manufacturing, Burgaw, North Carolina, United States |
| C, F, and I | Tek-Lok Mounter | Blade-Tech Industries, Streetsboro, Ohio, United States |
| D, E, F, G, and H | MOLLE LOK (short) set | Blade-Tech Industries, Streetsboro, Ohio, United States |
| C, F and I | Trifecta Connecta ™ | S&S Precision, Virginia Beach, Virginia, United States of America |
| D, E, F, and I | Quick Locking System Kit | Safariland, Ontario, Canada |

TABLE 1-continued

Figure 9A:
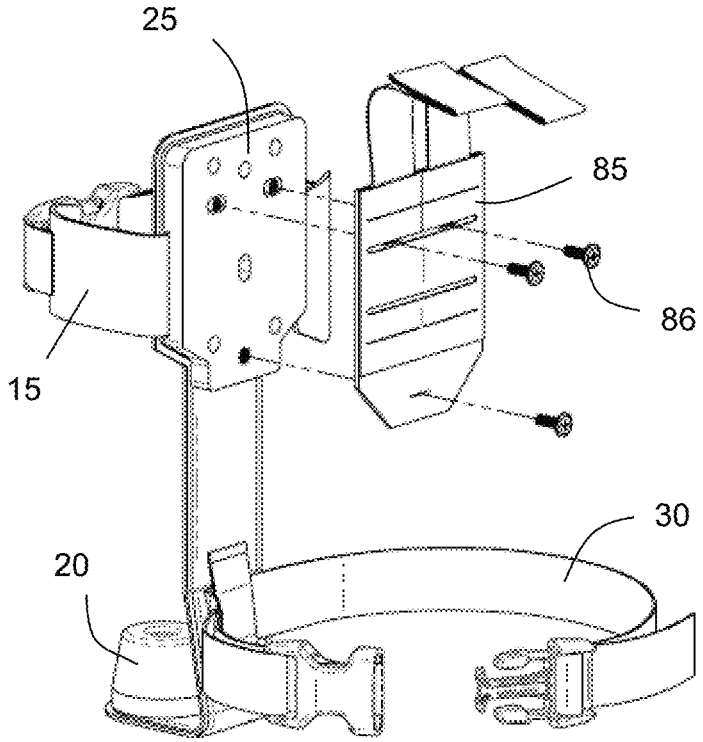
FIGS. 9*a* and 9*b* are perspective views illustrating the attachment of a connector in accordance with some embodiments of the presently disclosed subject matter.
Figure 9B:
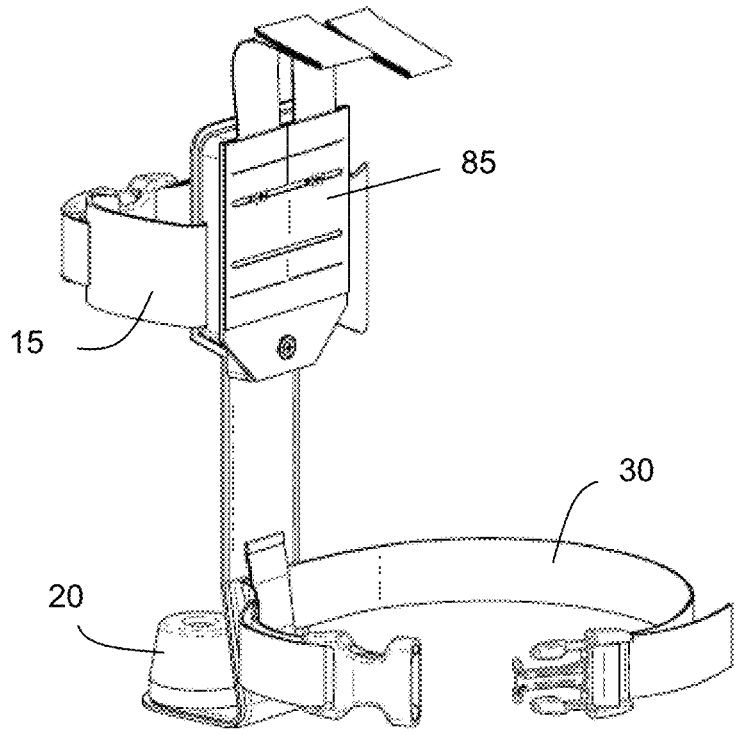

| Aperture Nos. | Connector | Source |
|---|---|---|
| D, E, F, and I | 745BL Clip-On Holster Belt Loop | Safariland, Ontario, Canada |
| A, B, F, and I | MOLLE strap connector | FIG. 9a and 9b, identified as 85 |

The holster spacer and frame hole patterns therefore allow universal connector mounting options. For example, a wide variety of commercially available mounting connectors can be used. In this way, belt mounting, drop leg mounting, and/or multiple equipment mounting options for holster system 5 are available. For example, the M320/M320A1 GLM stand-alone gun can be mounted easily on the operator's person or to equipment, as desired by the operator.

Figure 7A:
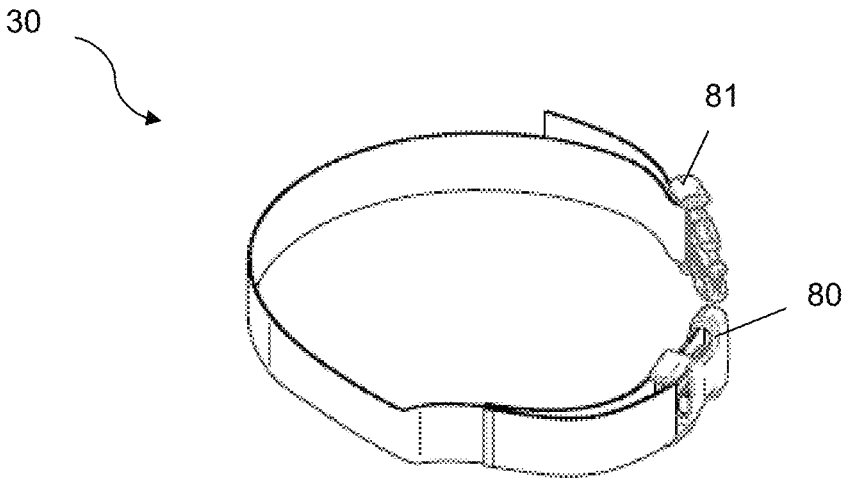
FIG. 7*a* is a perspective view of an attachment strap in accordance with some embodiments of the presently disclosed subject matter.

As set forth above, the holster system further includes optional attachment strap 30 that allows the holster system to be releasably attached to an operator or to a desired surface. For example, in some embodiments, the attachment strap allows the holster to encircle the leg of an operator. In other embodiments, the attachment strap can allow the holster to be attached to the operator's equipment. As shown in FIG. 7*a*, strap 30 can include fastener 80 that allows the strap to be opened and closed as desired by the user. Particularly, the fastener can be opened to allow a user to apply the strap around the operator's leg or attach it to an equipment item. The fastener can include any element that can open or close, such as (but not limited to) ties, VELCRO®, buckles, snaps, zippers, buttons, clasps, and the like.

In some embodiments, the size of the strap can be adjusted using tightener 81. In this way, the strap can be attached to a variety of items of varying circumferences (e.g., an operator's leg, an operator's arm, an operator's belt). Accordingly, the strap can be adjustable to accommodate a variety of supports of various sizes.

Figure 7B:
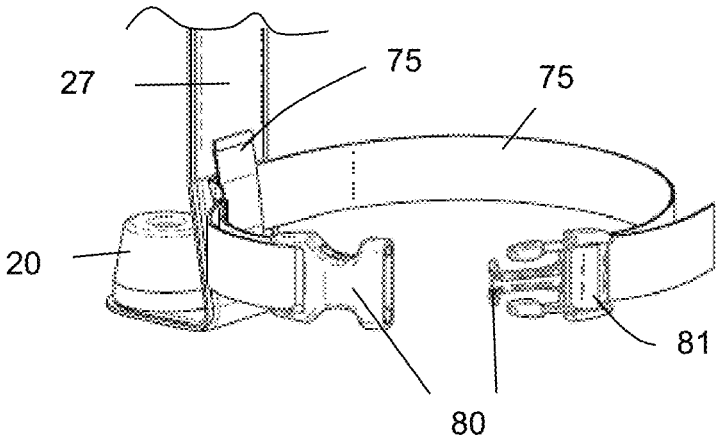
FIG. 7*b* is a perspective view of an attachment strap in accordance with some embodiments of the presently disclosed subject matter.

Strap 30 can be attached to rear face 27 of the frame using any suitable method. For example, the attachment can be held in place by clip 75, as shown in FIG. 7*b*. However, any mechanism can be used to attach the strap to the frame, such as adhesive, clips, sewing, buttons, fasteners, ties, and the like. Existing U.S. Government Issues (USGI) leg straps are compatible and easily integrated into the disclosed holster system. In some embodiments, the leg strap allows the M320/M320A1 GLM to be securely worn while engaged in extreme physical activity (e.g., lying prone or supine, sitting, standing, walking, crawling, running, jumping, kneeling, squatting, climbing, falling, and the like). However, weapon 35 is not limited and can include a variety of different guns and other weapons.

Strap 30 can be constructed from any desired material, such as fabric, leather, plastic, and the like. In some embodiments, the material used to construct strap 30 can have an elastic component to allow the user to easily move and bend without compromising the holster position.

Figure 8:
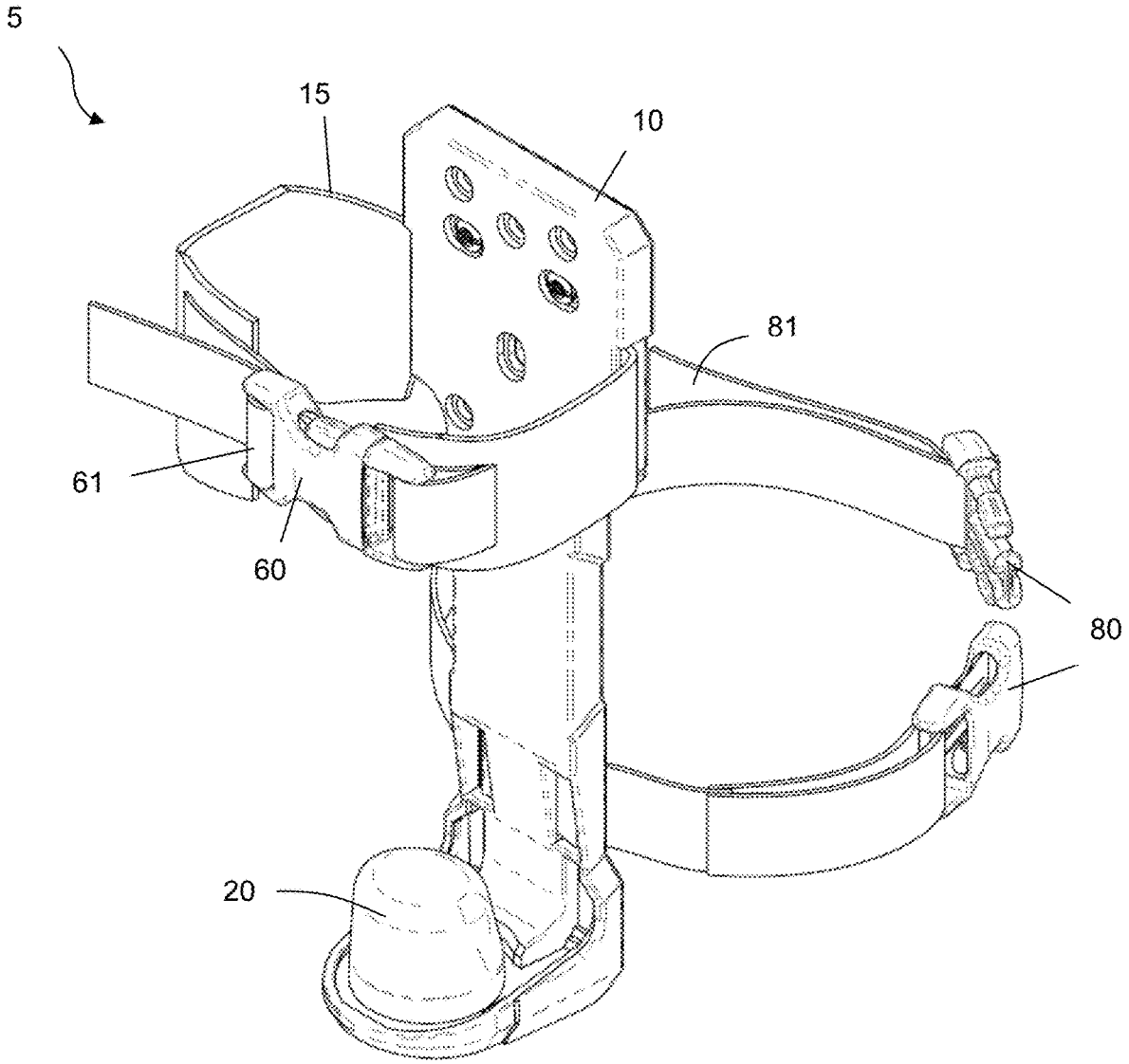
FIG. 8 is a perspective view of a holster system in accordance with some embodiments of the presently disclosed subject matter.

To assemble the disclosed holster system, fastener band 15 and spacer 25 are attached to frame plate 40. When assembled, a portion of the fastener band can be secured between the rear face of the frame and groove 70 of the spacer, as depicted in FIG. 6*a*. In some embodiments, the fastener band can be about perpendicular to vertical bracket 50 to define an approximate "T" shape. One or more mechanical elements (e.g., screws and nuts) can secure the fastener band and/or spacer to the frame, as discussed above. Alternatively, in some embodiments, rear face 27 of the frame can include groove 70 sized and shaped to accommodate the band of fastener band 15, as shown in FIG. 8.

The disclosed holster system can optionally include strap 30 to allow the system to be releasably attached to an operator's body or equipment as desired.

A desired connector 85 can be attached to the rear side of plate 25. The configuration of plate apertures 71 allow for the universal connection of a wide variety of connectors. For example, FIGS. 9*a* and 9*b* illustrate the attachment of connector 85 to the spacer. In some embodiments, less than all of the apertures are used to connect the connector. Although the connector is shown attached to spacer 25 through the use of hardware 86, any element can be used to attach the connector (e.g., pins, clips, magnets, VELCRO®, and the like). Connector 85 can include any desired accessory, such as (but not limited to) clips, strap connectors, locking forks, mounters, locking systems, clip-on holster belt loops, and the like.

In use, a weapon is positioned adjacent to the frame, secured by fastener band 15. Specifically, the weapon can be inserted muzzle first into the holster system and guided into position at least in part by bracket 50. In some embodiments, the fastener band closure can be opened to allow the weapon to be properly inserted. As the weapon is further inserted into the system, the barrel plug will be at least partially inserted into the barrel of the weapon. After the weapon is fully seated into frame 10, the fastener strap closure can be secured. As a result, removal of the weapon is not permitted unless the fastener band closure is released.

One or more connectors can be attached to the disclosed holster system. Particularly, the connector can attach to contact rear face 66 of the spacer. As discussed above, any of a wide variety of connectors can be attached and removed as desired by the operator.

The holster system can optionally be attached to the user's leg or equipment via strap 30. The operator can then go about his daily routine with his weapon close at hand. The holster system does not affect the ability of the operator to walk, sit, run, etc. When the weapon is needed, the operator simply removes the weapon from the holster by unfastening fastener band closure 60. The weapon can be removed and used as desired. When the operator is finished using the weapon, it can be re-holstered by positioning plug 20 in the barrel muzzle and refastening the fastener band closure 60.

Figure 10A:
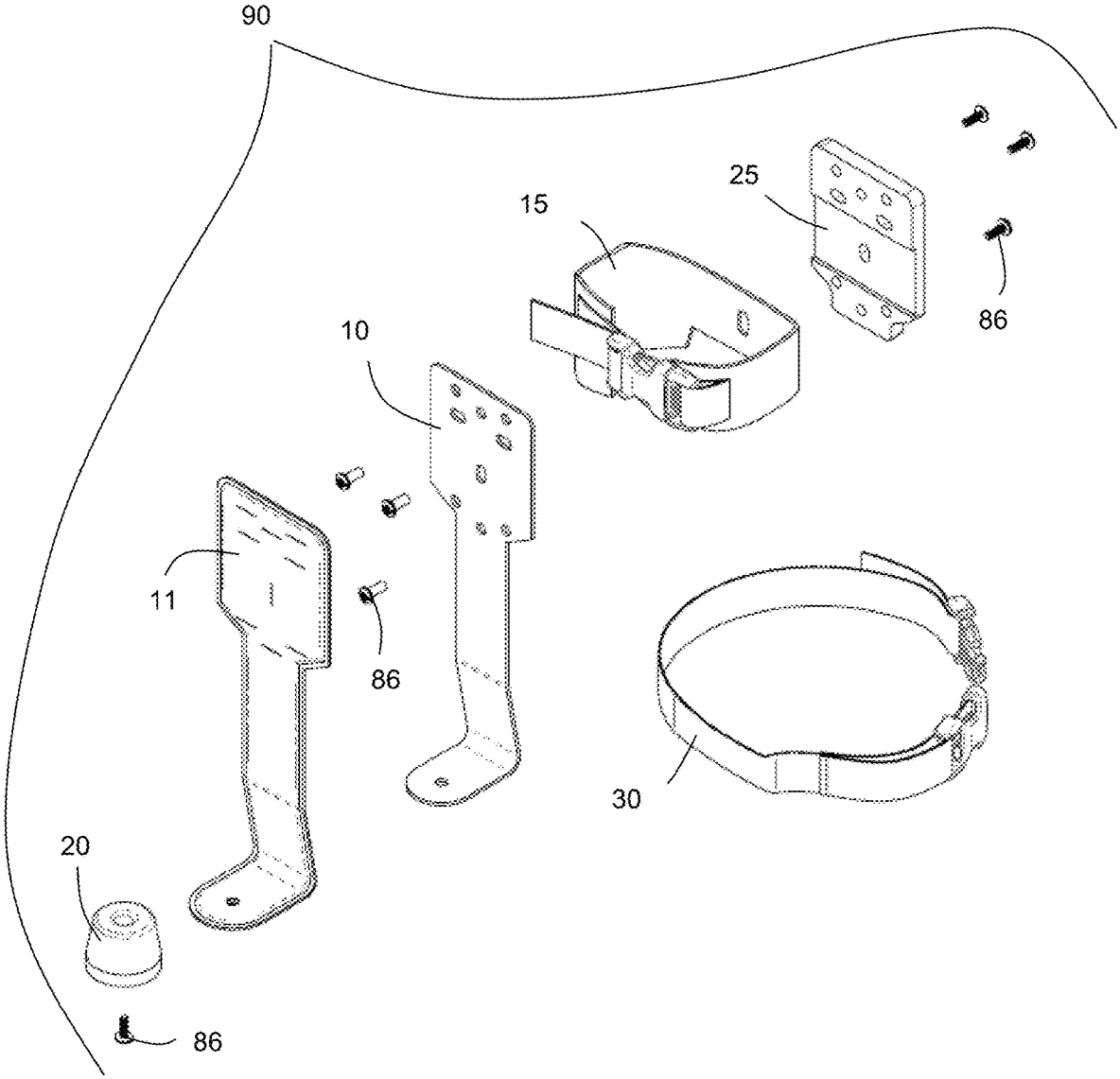
FIGS. 10*a* and 10*b* are schematics illustrating various optional components included in a particular kit in accordance with some embodiments of the presently disclosed subject matter.
Figure 10B:
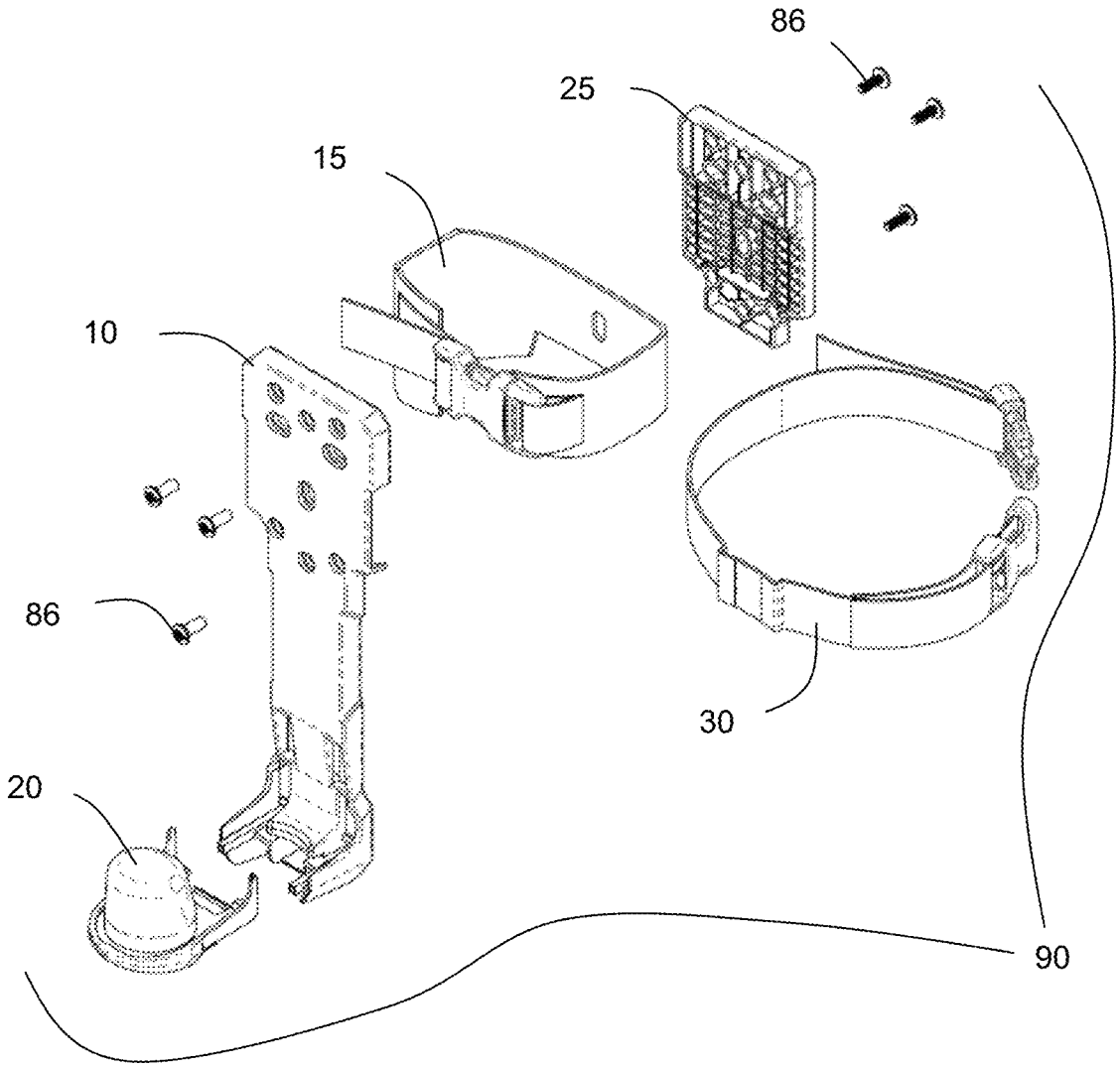

In some embodiments, the holster system can be provided as a kit. One example of several representative kit 90 components are illustrated in FIGS. 10*a* and 10*b*. For example, various alternatives of the system components can be provided to the operator, allowing for customization of the disclosed system. For example, a variety of optional coverings 11 can be included to allow the user to customize the frame depending on the weapon use environment (e.g., camouflage In addition, a variety of nozzle plugs 20 can be included to allow use with a selection of weapons. Likewise, variations of the fastener band can be included in the kit to allow the operator to select different closures or shapes/sizes of the fastener band as desired for user preference or to fit a particular weapon. The spacer can also be customized to have varying number and positions of apertures, allowing for connection to a variety of connectors.

The kit can optionally include a variety of attachment straps to allow the user to easily attach the system to the operator's body or to a piece of equipment.

The kit can further include several variations of connectors to allow the user to mix and match connectors as desired.

Holster system 5 provides many advantages over prior art holster systems. For example, the disclosed system allows for the easy and quick removal and re-holstering of a weapon by opening and closing closure 60 of the fastener band.

The system further accommodates a wide variety of weapons by allowing the barrel plug and/or fastener band to be switched and/or sized as needed (such as the M320 GLM).

The disclosed system is lightweight, allowing the user the freedom to do their usual everyday activities, while allowing his weapon to be kept close at hand.

The holster system is capable of retaining a weapon securely, while also permitting quick release of the weapon when desired.

Holster system 5 further allows a wide variety of connectors to be used. As discussed above, the spacer is universal.

Advantageously, the holster can allow ambidextrous wear by reorienting of the existing fastener strap/fastener band and the attached fastener buckles. In some embodiments, webbing (e.g., 1 inch nylon webbing) is internally routed unbroken through the fastener strap, and the fastener buckles are affixed to both distal ends of the webbing. Strap orientation changes cannot be completed with the holster worn or mounted on the operator or on equipment. In addition, weapon 35 must be removed prior to the change-over operation.

To reorient the strap (left versus right draw), any fasteners are removed from the frame to allow separation of the frame from the fastener band strap, spacer, and any connector that is being utilized. The holster components can be separated by removing the screw and nut hardware in some embodiments. The strap is then flipped 180 degrees horizontally while maintaining the vertical alignment in the slotted space between the channel formed between the frame and spacer when they are interfaced with each other. Depending on which connector option is being used, the hole utilization pattern can vary. In some embodiments, the center hole (e.g., FIG. 6*e*) can be utilized to secure horizontal alignment.

When properly attached, the fastener buckles are positioned on the outside of the fastener strap (e.g., the non-weapon side). If the fastener buckles are positioned on the incorrect side of the fastener strap, the fastener buckles can be removed from both distal ends of the fastener strap. Each webbing is then pushed through the proximal routing slit on the fastener strap to the opposing side (the routing slits communicate to both sides of the fastener strap). With both ends properly routed, the fastener buckles can be reconnected to the webbing ends. The holster can then properly receive weapon 35.

Accordingly, fastener strap is capable of ambidextrous reorientation to the opposing side draw (left side versus right side). The reorientation secures and properly aligns the fastener strap within the strap channel between the holster frame and the spacer. The proper fastener buckle position is also reconciled.

Figure 11:
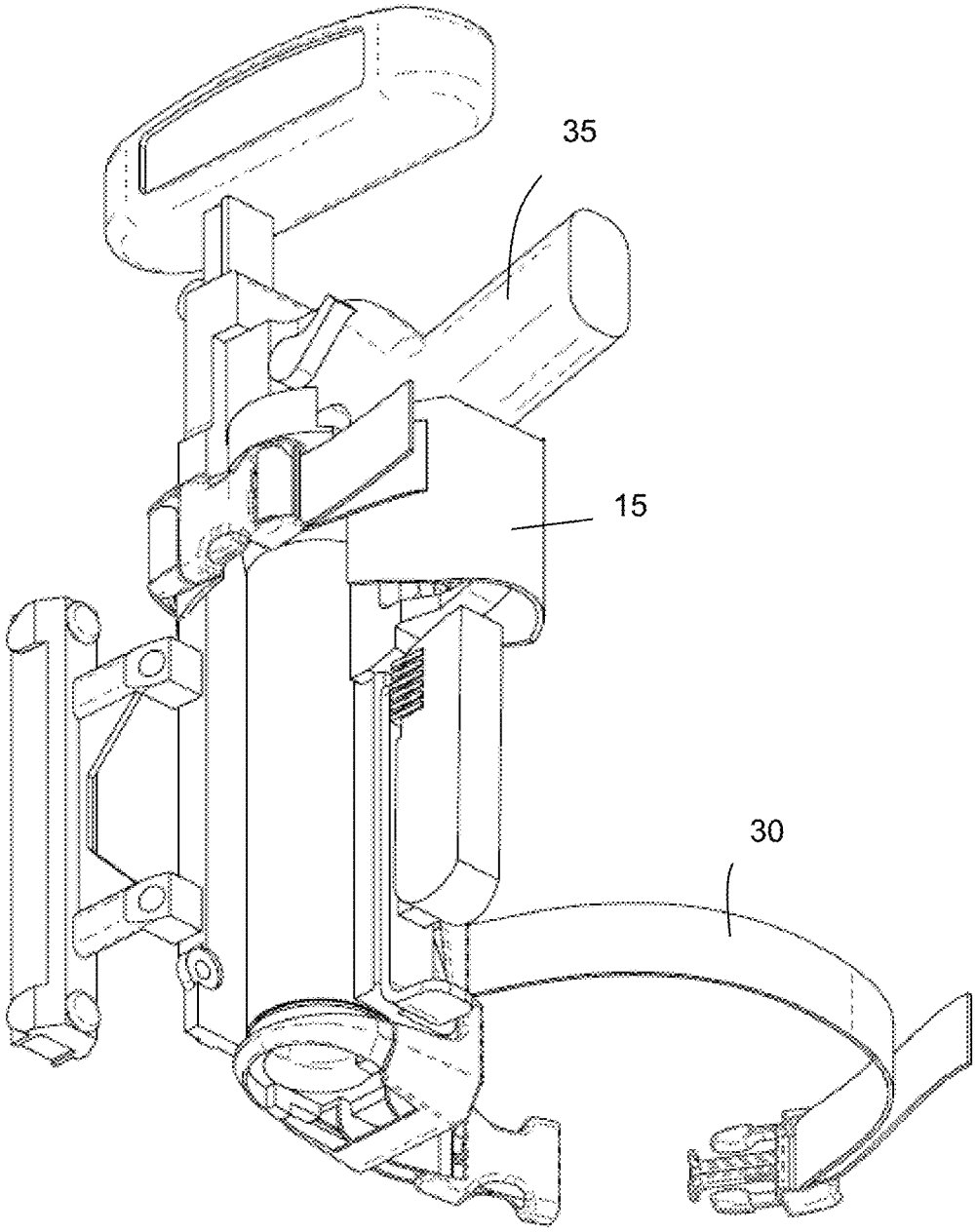
FIG. 11 is a perspective view of a left-handed draw orientation of a holster system in accordance with some embodiments of the presently disclosed subject matter.

Alternatively, holster 5 can be configured in dedicated left-hand or right-hand versions (e.g., non-ambidextrous models). Specifically, FIG. 1*b* illustrates a right-handed draw holster, and FIG. 11 illustrates a corresponding left-handed draw holster.

The holster also includes a vertical streamline frame design that allows the holster to be closely worn next to the user's body when worn on a person. This allows for quick and easy access to weapon 35.

All or a portion of holster 5 can be constructed with any desired coloration and/or camouflage. As a result, the holster can be on par with U.S. military camouflage guidelines.

The holster is lightweight, yet durable to meet U.S. military fielding requirements.

The foregoing descriptions have been presented for purposes of illustration and description and are not intended to be exhaustive or to limit the presently disclosed subject matter. Many modifications and variations are possible in light of the present disclosure.

What is claimed is:

1. A holster system comprising:

a support frame comprising:
- a support frame front face;
- a support frame rear face;
- a first end defined by an attachment plate comprising a plate front face and a plate rear face;
- a second end defined by a ledge, wherein the ledge comprises a top face and a bottom face; and
- a bracket disposed between the first and second ends; wherein the attachment plate comprises a plurality of slots;

a barrel plug positioned on the top face of the bracket;

a spacer positioned directly adjacent to the rear face of the support frame, wherein the spacer is defined by a plurality of apertures that align with the attachment plate slots;

a fastener band comprising a closure, wherein a portion of the fastener band is positioned between the rear face of the support frame and the front face of the spacer, whereby the front face of the spacer, the rear face of the support frame, or both comprise a groove sized and shaped to accommodate the portion of the fastener band positioned between rear face of the support frame and the front face of the spacer.

2. The holster system of claim 1, further comprising a covering that at least partially fits over the support frame, wherein the covering includes a plurality of openings that align with the support frame slots and the spacer apertures.

3. The holster system of claim 1, further comprising a connector releasably attached to the rear face of the spacer via the spacer apertures.

4. The holster system of claim 1, comprising about 2-20 slots, apertures, or both.

5. The holster system of claim 1, wherein the ridge comprises a first segment that includes the barrel plug and a second section attached to the bracket, wherein the first and second segments can be releasably attached together.

6. The holster system of claim 1, wherein the support frame is configured as in an L-shape.

7. The holster system of claim 1, wherein the barrel plug comprises a first end and a second end, and wherein the barrel plug tapers from the second end to the first end.

8. The holster system of claim 1, wherein the fastener band further includes an adjuster that allows the band to be enlarged or decreased in circumference.

9. The holster system of claim 1, wherein the apertures are threaded.

10. The holster system of claim 1, wherein the apertures of the spacer are configured to provide universal connectivity to two or more different connectors.

11. The holster system of claim 1, further comprising an attachment strap that allows the system to be releasably attached to a support surface.

12. The holster system of claim 1, wherein the system is configured to switch between right-hand and left hand orientations.

13. A holster system kit comprising:

at least one support frame, each comprising:

a support frame front face;

a support frame rear face;

a first end defined by an attachment plate comprising a plate front face and a plate rear face;

a second end defined by a ledge, wherein the ledge comprises a top face and a bottom face; and a bracket disposed between the first and second ends;

wherein the attachment plate comprises a plurality of slots;

at least one barrel plug configured to be attached to the top face of the bracket;

at least one spacer positioned directly adjacent to the rear face of the support frame, wherein the spacer is defined by a plurality of apertures that align with the attachment plate slots;

at least one fastener band comprising a closure, wherein a portion of the fastener band is positioned between the rear face of the support frame and the front face of the spacer, whereby the front face of the spacer, the rear face of the support frame, or both comprise a groove sized and shaped to accommodate the portion of the fastener band positioned between rear face of the support frame and the front face of the spacer.

14. The kit of claim 13, further comprising:

at least one covering that at least partially fits over the support frame, wherein each covering comprises a plurality of slots;

at least one connector configured to releasably attach to the rear face of the spacer via the spacer apertures;

at least one attachment strap that allows the system to be releasably attached to a support; or combinations thereof.

15. The kit of claim 13, further comprising at least one connector configured to releasably attach to the rear face of the spacer via the spacer apertures.

16. A method of releasably attaching a connector to a holster system, the method comprising:

selecting a desired connector;

releasably attaching the connector to the rear face of a holster system spacer by aligning connector openings with aligned apertures in the spacer and securing together using a mechanical element, wherein the holster system comprises:

a support frame comprising:

a support frame front face;

a support frame rear face;

a first end defined by an attachment plate comprising a plate front face and a plate rear face;

a second end defined by a ledge, wherein the ledge comprises a top face and a bottom face; and a bracket disposed between the first and second ends;

wherein the attachment plate comprises a plurality of slots;

a barrel plug positioned on the top face of the bracket;

a spacer positioned directly adjacent to the rear face of the support frame, wherein the spacer is defined by a plurality of apertures that align with the attachment plate slots;

a fastener band comprising a closure, wherein a portion of the fastener band is positioned between the rear face of the support frame and the front face of the spacer, whereby the front face of the spacer, the rear face of the support frame, or both comprise a groove sized and shaped to accommodate the portion of the fastener band positioned between rear face of the support frame and the front face of the spacer;

wherein the connector can be detached from the spacer and replaced with a different connector.

17. The method of claim 16, wherein the connector is selected from clips, strap connectors, locking forks, mounters, locking systems, or clip-on holster belt loops.

18. The method of claim 16, wherein the apertures are threaded.

19. The method of claim 16, wherein the apertures of the spacer are configured to provide universal connectivity to two or more different connectors.

20. The method of claim 16, wherein the holster system comprises about 2-20 slots, apertures, or both.

* * * * *